US007365032B1

(12) United States Patent
Adachi et al.

(10) Patent No.: US 7,365,032 B1
(45) Date of Patent: Apr. 29, 2008

(54) FLAME-RETARDANT UNION FABRIC

(75) Inventors: Masayuki Adachi, Kobe (JP); Masaharu Fujii, Takasago (JP); Toshimitsu Mori, Hyogo (JP); Akio Konishi, Kakogawa (JP)

(73) Assignee: Kaneka Corporation, Osaka (JP)

( * ) Notice: Subject to any disclaimer, the term of this patent is extended or adjusted under 35 U.S.C. 154(b) by 0 days.

(21) Appl. No.: 10/129,407

(22) PCT Filed: Oct. 31, 2000

(86) PCT No.: PCT/JP00/07672

§ 371 (c)(1),
(2), (4) Date: May 2, 2002

(87) PCT Pub. No.: WO01/32968

PCT Pub. Date: Oct. 5, 2001

(30) Foreign Application Priority Data

Nov. 4, 1999 (JP) ..... 11-314054

(51) Int. Cl.
*G03D 15/00* (2006.01)
*D02G 3/00* (2006.01)

(52) U.S. Cl. ..... 442/301; 442/208; 442/209; 442/210; 442/211; 442/212; 442/217; 428/373

(58) Field of Classification Search ..... 428/364, 428/296.7, 365, 373, 394, 424.7; 442/301, 442/208–212, 217
See application file for complete search history.

(56) References Cited

U.S. PATENT DOCUMENTS 4,127,698 A 11/1978 Shimizu et al.
4,863,797 A * 9/1989 Ichibori et al. ..... 428/359

FOREIGN PATENT DOCUMENTS

| | | |
|---|---|---|
| EP | 0 183 014 | 6/1986 |
| JP | 408226031 A * | 9/1996 |
| JP | 10-1821 | 1/1998 |
| WO | WO 97/42363 | 11/1997 |

* cited by examiner

*Primary Examiner*—Lynda Salvatore
(74) *Attorney, Agent, or Firm*—Brinks Hofer Gilson & Lione

(57) ABSTRACT

A flame retardant union fabric obtained by combining (A) 30 to 70% by weight of a fiber comprising as a main component a flame retardant halogen-containing fiber made of a composition comprising 100 parts by weight of an acrylic copolymer of 30 to 70% by weight of acrylonitrile, 30 to 70% by weight of a halogen-containing vinyl monomer and 0 to 10% by weight of a vinyl monomer copolymerizable with them, 10 to 30 parts by weight of an antimony compound and 8 to 30 parts by weight of a zinc stannate compound, with (B) 70 to 30% by weight of a cellulosic fiber. The flame retardant union fabric shows a high flame resistance which passes the M1 class of NF P 92-503 burning test in France even after the post-treatment.

10 Claims, No Drawings

FLAME-RETARDANT UNION FABRIC

RELATED APPLICATIONS

This application is a nationalization of PCT application PCT/JP00/07672 filed Oct. 31, 2000. This application claims priority from the PCT application and Japan Application Ser. No. 11-314054 filed Nov. 4, 1999.

TECHNICAL FIELD

The present invention relates to a flame retardant union fabric, and more particularly to a union fabric having a high flame resistance which is made of a cellulosic fiber and a fiber comprising as a main component a halogen-containing flame retardant fiber containing both an antimony compound and a zinc stannate compound.

BACKGROUND ART

Flame retardant materials have been increasingly needed because of recent strong demands of ensuring safety of food, clothing and shelter. Under such circumstances, many proposals have been made wherein a general-purpose flammable fiber is combined with a flame retardant fiber having a high flame resistance to form a composite material in order to impart a flame resistance to the flammable fiber while maintaining the properties of the flammable fiber. As a method of preparing such a composite material, for instance, Japanese Patents No. 2,593,985 and No. 2,593,986 propose, when combining a halogen-containing flame retardant fiber and a natural fiber, using an antimony compound as a flame retardant to be incorporated into the halogen-containing flame retardant fiber.

Recently, union fabrics prepared using a general-purpose cellulosic fiber as a warp and a halogen-containing flame retardant fiber incorporated with an antimony compound as a weft are popularly used in interior goods such as curtain and upholstery since it is possible to make the best use of the features of the cellulosic fiber such as natural feel, hygroscopic property and heat resistance. Among others, union fabrics having jacquard, dobby or satin structure prepared using a cellulosic fiber as a warp and a flame retardant halogen-containing fiber incorporated with an antimony compound as a weft are characteristic fabrics that the cellulosic fiber appears in a large quantity on the right face of the fabric.

However, even if the above-mentioned technique is applied to these union fabrics, it is the actual situation that they do not pass the M1 class of the highest flame resistance in NF P 92-503 burning test in France which requires a high level of flame resistance.

That is to say, it is the actual situation that none of known union fabrics made of a cellulosic fiber and a flame retardant halogen-containing fiber pass the M1 class of the NF P 92-503 burning test. The reasons are considered to be that the NF P 92-503 burning test is a very severe burning test such that after previously heating a test fabric with an electric heater for 20 seconds, the fabric is ignited and the afterflame time must be within 5 seconds, and that in case of union fabrics having jacquard, dobby or satin structure, there are portions in a fabric where the cellulosic fiber and the flame retardant halogen-containing fiber are unevenly distributed respectively and these portions show a lower flame resistance against this burning test since the heat source is large.

Explaining in more detail, in this burning test both the right face and the reverse face of a fabric are subjected to the test. An antimony compound called a gas type flame retardant is effective against a flame applied to a face on which a cellulosic fiber unevenly appears much and, on the other hand, a tin flame retardant called a carbonizing type flame retardant is effective against a flame applied to a face on which a flame retarded halogen-containing fiber unevenly appears much. However, there has hitherto not been known a flame retardant or a combination of flame retardants which exhibits a combustion-inhibiting effect for both of the face on which the cellulosic fiber appears much and the face on which the cellulosic fiber appears only slightly.

Thus, it has been desired to develop a union fabric which shows a high flame resistance even in a combination of a flame retarded halogen-containing fiber and a cellulosic fiber and which is classified into the M1 class of the NF P 92-503 burning test in France.

Thus, the present inventors repeatedly made a study on a union fabric comprising a modacrylic fiber as a flame-retarded halogen-containing fiber and a cellulosic fiber. As a result, the present inventors have found that a high flame resistance can be exhibited even with respect to union fabrics such as those having jacquard, dobby or satin structure when a predetermined amount of an antimony compound and a predetermined amount of a zinc stannate compound are used in combination as a flame retardant to be added to the modacrylic fiber, thus having accomplished the present invention.

DISCLOSURE OF INVENTION

The present invention provides a flame retardant union fabric obtained by combining (A) 30 to 70% by weight of a fiber comprising as a main component a flame retardant halogen-containing fiber made of a composition comprising 100 parts by weight of an acrylic copolymer of 30 to 70% by weight of acrylonitrile, 30 to 70% by weight of a halogen-containing vinyl monomer and 0 to 10% by weight of a vinyl monomer copolymerizable with them, 10 to 30 parts by weight of an antimony compound and 8 to 30 parts by weight of a zinc stannate compound, with (B) 70 to 30% by weight of a cellulosic fiber.

In the flame retardant union fabric, the fiber (A) comprising a flame retardant halogen-containing fiber as a main component is preferably a composite fiber of 80 to 100% by weight of the flame retardant halogen-containing fiber and 0 to 20% by weight of a cellulosic fiber. Also, the cellulosic fiber (B) is preferably at least one fiber selected from the group consisting of cotton, hemp, rayon, polynosic, cuprammonium rayon, acetate and triacetate.

The present invention further provides a flame retardant union fabric obtained by combining (A) 30 to 70% by weight of a fiber comprising as a main component a flame retardant halogen-containing fiber made of a composition comprising 100 parts by weight of an acrylic copolymer of 30 to 70% by weight of acrylonitrile, 30 to 70% by weight of a halogen-containing vinyl monomer and 0 to 10% by weight of a vinyl monomer copolymerizable with them, 10 to 30 parts by weight of an antimony compound and 10.5 to 30 parts by weight of a zinc stannate compound, with (B) 70 to 30% by weight of a cellulosic fiber. In this flame retardant union fabric, the fiber (A) comprising a flame retardant halogen-containing fiber as a main component is preferably a composite fiber of 80 to 100% by weight of the flame retardant halogen-containing fiber and 0 to 20% by weight of a cellulosic fiber. Also, the cellulosic fiber (B) is preferably at least one fiber selected from the group consisting of cotton, hemp, rayon, polynosic, cuprammonium rayon, acetate and triacetate.

BEST MODE FOR CARRYING OUT THE INVENTION

In the present invention, the fiber (A) comprising a flame retardant halogen-containing fiber as a main component (hereinafter also referred to as "fiber (A)") is used in order to impart a flame resistance to the union fabrics of the present invention. The fiber (A) comprises a composition wherein an antimony compound and a zinc stannate compound are incorporated into an acrylic copolymer prepared by polymerizing a monomer mixture containing 30 to 70% by weight of acrylonitrile, 30 to 70% by weight of a halogen-containing vinyl monomer and 0 to 10% by weight of a vinyl monomer copolymerizable with these acrylonitrile and halogen-containing vinyl monomer (hereinafter referred to as "copolymerizable vinyl monomer").

The content of acrylonitrile in the monomer mixture used to obtain the acrylic copolymer is not less than 30% by weight, preferably not less than 40% by weight (lower limit), and is not more than 70% by weight, preferably not more than 60% by weight (upper limit). The content of the halogen-containing vinyl monomer in the monomer mixture is not less than 30% by weight, preferably not less than 40% by weight (lower limit), and is not more than 70% by weight, preferably not more than 60% by weight (upper limit). The content of the copolymerizable vinyl monomer in the monomer mixture is preferably not less than 1% by weight (lower limit), and is not more than 10% by weight, preferably not more than 5% by weight (upper limit). Of course, the total of acrylonitrile, the halogen-containing vinyl monomer and the copolymerizable vinyl monomer is 100% by weight.

If the content of acrylonitrile in the monomer mixture is less than the above-mentioned lower limit or the content of the halogen-containing vinyl monomer is more than the above-mentioned upper limit, the heat resistance becomes insufficient. If the content of acrylonitrile in the monomer mixture is more than the above-mentioned upper limit or the content of the halogen-containing vinyl monomer is less than the above-mentioned lower limit, the flame resistance becomes insufficient. Also, if the content of the copolymerizable vinyl monomer in the monomer mixture is more than the above-mentioned upper limit, the flame resistance and feeling which are characteristics of the flame retarded halogen-containing fiber are not sufficiently utilized.

As the halogen-containing vinyl monomer can be used any of vinyl monomers containing a halogen atom, preferably chlorine atom or bromine atom. Examples of the halogen-containing vinyl monomer are, for instance, vinyl chloride, vinylidene chloride, vinyl bromide and the like. These may be used alone or in admixture thereof.

Examples of the copolymerizable vinyl monomer are, for instance, acrylic acid; an acrylic ester such as ethyl acrylate or propyl acrylate; methacrylic acid; a methacrylic ester such as methyl methacrylate or ethyl methacrylate; vinyl sulfonic acid; a vinyl sulfonic acid salt such as sodium vinyl sulfonate; styrene sulfonic acid; a styrene sulfonic acid salt such as sodium styrene sulfonate; and the like. These may be used alone or in admixture thereof.

The polymerization of the monomer mixture containing acrylonitrile, the halogen-containing monomer and the copolymerizable monomer to prepare acrylic copolymers can be conducted by a usual vinyl polymerization method, for instance, any of methods such as slurry polymerization method, emulsion polymerization method and solution polymerization method, and is not particularly restricted.

Preferable examples of the antimony compound are, for instance, inorganic antimony compounds such as antimony trioxide, antimony pentoxide, antimonic acid and antimony oxychloride. The antimony compounds may be used alone or in admixture thereof.

Preferable examples of the zinc stannate compound are, for instance, zinc stannate, zinc hydroxystannate, and the like. These may be used alone or in admixture thereof.

The antimony compound and the zinc stannate compound both are flame retardants, and it is one of significant features of the present invention to use both of them in specific amounts.

The amount of the antimony compound is, per 100 parts by weight of the acrylic copolymer, not less than 10 parts by weight, preferably not less than 12 parts by weight, more preferably not less than 15 parts by weight (lower limit), and is not more than 30 parts by weight, preferably not more than 25 parts by weight (upper limit). The amount of the zinc stannate compound is, per 100 parts by weight of the acrylic copolymer, not less than 8 parts by weight, preferably not less than 10.5 parts by weight, more preferably not less than 12 parts by weight, the most preferably not less than 15 parts by weight (lower limit), and is not more than 30 parts by weight, preferably not more than 20 parts by weight (upper limit).

If the amount of the antimony compound is less than the lower limit and/or if the amount of the zinc stannate compound is less than the lower limit, the flame resistance of the obtained flame retardant union fabric cannot be sufficiently ensured. If the amount of the antimony compound is more than the upper limit and/or if the amount of the zinc stannate compound is more than the upper limit, problems arise that the physical properties of the flame retardant halogen-containing fiber such as strength and elongation are deteriorated or a nozzle is choked during the preparation. From the viewpoint that union fabrics having a high flame resistance can be obtained, it is desirable that in the stages after the softening finish and the water-oil repellent finish, the amount of the antimony compound and/or the zinc stannate compound is not less than 12 parts by weight, preferably not less than 15 parts by weight, per 100 parts by weight of the acrylic copolymer.

As a method for obtaining a composition (flame retardant halogen-containing fiber) by including flame retardants into the acrylic copolymer are mentioned a method wherein the acrylic copolymer is dissolved in a solvent capable of dissolving the copolymer, flame retardants are dispersed into the resulting solution, and a fiber is formed from the solution, and methods wherein flame retardants are included into a fiber by post-processing, for example, by dipping a fiber made of the acrylic copolymer in an aqueous solution of a binder containing flame retardants and, squeezing, drying and heat-treating the fiber. The method for obtaining the flame retardant halogen-containing fiber is not limited to these methods, and other known methods are applicable.

The fiber (A) comprises the above-mentioned flame retardant halogen-containing fiber as a main component, and may contain other fibers. Preferable other fibers are cellulosic fibers.

The term "comprising a flame retardant halogen-containing fiber as a main component" as used herein means that the flame retardant halogen-containing fiber is included in the fiber (A) in an amount of preferably not less than 80% by weight, more preferably not less than 90% by weight and preferably not more than 100% by weight, and other fibers such as cellulosic fiber are included in the fiber (A) in an amount of preferably not more than 20% by weight, more preferably not more than 10% by weight and preferably not less than 0% by weight. Of course, the total of the flame retardant halogen-containing fiber and other fibers is 100% by weight.

If the proportion of other fibers such as cellulosic fiber in the fiber (A) is too large, the flame resistance is deteriorated although natural feeling of the cellulosic fiber and a higher heat resistance are obtained.

In case of including other fibers such as cellulosic fibers into the fiber (A), the manner of including is not particularly limited and can be achieved, for instance, by mixing the fiber (A) with other fibers.

As the cellulosic fibers can be used those exemplified for the cellulosic fiber (B) mentioned after.

The flame retardant union fabric of the present invention is prepared by combining the fiber (A) with cellulosic fiber (B) (hereinafter also referred to as "fiber (B)") used for imparting a heat resistance and natural feeling.

The cellulosic fiber (B) is not particularly limited, but from the viewpoint of capable of imparting a natural feeling is preferred at least one fiber selected from the group consisting of cotton, hemp, rayon, polynosic, cuprammonium rayon, acetate and triacetate. Of these, cotton fiber is particularly preferred from the viewpoint of many advantages such as durability to washing, dye-affinity and low cost.

The flame retardant union fabric of the present invention is a composite material composed of 30 to 70% by weight of the fiber (A) and 70 to 30% by weight of the fiber (B). The proportion of the fiber (A) in the flame retardant union fabric is not less than 30% by weight, preferably not less than 40% by weight (lower limit), and is not more than 70% by weight, preferably not more than 60% by weight (upper limit). On the other hand, the proportion of the fiber (B) in the flame retardant union fabric is not less than 30% by weight, preferably not less than 40% by weight (lower limit), and is not more than 70% by weight, preferably not more than 60% by weight (upper limit). The total of the fibers (A) and (B) is 100% by weight.

If the proportion of the fiber (A) in the flame retardant union fabric is less than the above lower limit, no sufficient flame resistance is obtained, and if the proportion is more than the above upper limit, the characteristics of the fiber (B) cannot be sufficiently exhibited.

The term "flame retardant union fabric obtained by combining" as used herein means a union cloth fabric prepared by weaving a yarn of fiber (A) and a yarn of fiber (B) as warp and weft.

The reason why the flame retardant union fabric of the present invention shows a high flame resistance of M1 class in NF P 92-503 burning test is not clear, but for example the following reasons are considered.

(1) The zinc stannate compound exhibits a synergistic effect by a combination with the antimony compound and the flame retardant halogen-containing fiber to show a very large flame retarding action.

(2) The zinc stannate compound acts on flame retardation based on carbonization during heating for 20 seconds with an electric heater, thus effectively contributing to carbonizing flame retardation even prior to applying a flame.

(3) The zinc stannate compound serves not only as a carbonizing type flame retardant, but also as a gas type flame retardant, thus showing different actions and effects from those of conventional tin flame retardants.

The flame retardant union fabric of the present invention is more specifically explained by means of the following examples, but it is to be understood that the present invention is not limited to these examples.

The flame resistance of union fabrics was evaluated by the following method.

(Flame Resistance)

The flame resistance of union fabrics was evaluated according to NF P 92-503 burning test in France. Briefly explaining the NF P 92-503 burning test, a test fabric is tilted at 30° with respect to the horizontal direction, and a 500 W electric heater is brought close to the fabric. After 20 seconds, 45 seconds, 75 seconds, 105 seconds, 135 seconds and 165 seconds from starting the heating with the electric heater, a flame from a burner is applied to the fabric for 5 seconds. The flame resistance is evaluated by the afterflame time and the length of carbonization measured at each application of flame. This test is a very severe burning test since a burner flame is applied while heating with an electric heater.

The burning was conducted with respect to four directions, namely warp direction of front face, warp direction of back face, weft direction of front face and weft direction of back face. The determination was conducted based on the following NF P 92-507 criteria.

M1: The afterflame time is within 5 seconds with respect to all tests of four directions.

M2: With respect to at least one of the four direction tests, the afterflame time exceeds 5 seconds and the average length of carbonization is not more than 35 cm.

M3: With respect to at least one of the four direction tests, the afterflame time exceeds 5 seconds and the average length of carbonization is not more than 60 cm.

PREPARATION EXAMPLE 1

Preparation of Flame Retardant Halogen-Containing Fiber

A copolymer prepared by copolymerization of 52 parts by weight of acrylonitrile, 46.8 parts by weight of vinylidene chloride and 1.2 parts by weight of sodium styrene sulfonate was dissolved in acetone to give a 30% by weight solution. To the solution were added as a flame retardant 10 parts by weight of antimony trioxide and 12 parts by weight of zinc hydroxystannate per 100 parts by weight of the copolymer to give a spinning solution. The spinning solution was extruded into a 38% by weight aqueous solution of acetone kept at 25° C. through a nozzle having 15,000 holes and a hole diameter of 0.08 mm. After washing the resulting filaments with water and drying at 120° C. for 8 minutes, the filaments were drawn at 150° C. in a draw ratio of 3 times and then heat-treated at 175° C. for 30 seconds to give a flame retardant halogen-containing fiber having a fineness of 3 dtex. A finishing oil agent for spinning (made by Takemoto Yushi Kabushiki Kaisha) was supplied to the obtained flame retardant halogen-containing fiber. The fiber was then provided with crimp and cut to a length of 38 mm. A spun yarn with a metric count of 17 was prepared from the cut fiber.

PREPARATION EXAMPLE 2

Preparation of Flame Retardant Halogen-Containing Fiber

A flame retardant halogen-containing fiber was prepared in the same manner as in Preparation Example 1 except that 15 parts by weight of antimony trioxide and 15 parts by weight of zinc hydroxystannate were used as a flame retardant per 100 parts by weight of the copolymer, and a spun yarn with a metric count of 17 was prepared therefrom.

PREPARATION EXAMPLE 3

Preparation of Flame Retardant Halogen-Containing Fiber

A flame retardant halogen-containing fiber was prepared in the same manner as in Preparation Example 1 except that 26 parts by weight of antimony trioxide and 8 parts by weight of zinc hydroxystannate were used as a flame retardant per 100 parts by weight of the copolymer, and a spun yarn with a metric count of 17 was prepared therefrom.

PREPARATION EXAMPLE 4

Preparation of Flame Retardant Halogen-Containing Fiber

A flame retardant halogen-containing fiber was prepared in the same manner as in Preparation Example 1 except that 23 parts by weight of antimony trioxide and 11 parts by weight of zinc hydroxystannate were used as a flame retardant per 100 parts by weight of the copolymer, and a spun yarn with a metric count of 17 was prepared therefrom.

PREPARATION EXAMPLE 5

Preparation of Flame Retardant Halogen-Containing Fiber

A flame retardant halogen-containing fiber was prepared in the same manner as in Preparation Example 1 except that 20 parts by weight of antimony trioxide and 14 parts by weight of zinc hydroxystannate were used as a flame retardant per 100 parts by weight of the copolymer, and a spun yarn with a metric count of 17 was prepared therefrom.

COMPARATIVE PREPARATION EXAMPLE 1

Preparation of Flame Retardant Halogen-Containing Fiber

A flame retardant halogen-containing fiber was prepared in the same manner as in Preparation Example 1 except that 25 parts by weight of antimony trioxide was used as a flame retardant per 100 parts by weight of the copolymer, and a spun yarn with a metric count of 17 was prepared therefrom.

COMPARATIVE PREPARATION EXAMPLE 2

Preparation of Flame Retardant Halogen-Containing Fiber

A flame retardant halogen-containing fiber was prepared in the same manner as in Preparation Example 1 except that 25 parts by weight of zinc hydroxystannate was used as a flame retardant per 100 parts by weight of the copolymer, and a spun yarn with a metric count of 17 was prepared therefrom.

COMPARATIVE PREPARATION EXAMPLE 3

Preparation of Flame Retardant Halogen-Containing Fiber

A flame retardant halogen-containing fiber was prepared in the same manner as in Preparation Example 1 except that 5 parts by weight of antimony trioxide and 15 parts by weight of zinc hydroxystannate were used as a flame retardant per 100 parts by weight of the copolymer, and a spun yarn with a metric count of 17 was prepared therefrom.

COMPARATIVE PREPARATION EXAMPLE 4

Preparation of Flame Retardant Halogen-Containing Fiber

A flame retardant halogen-containing fiber was prepared in the same manner as in Preparation Example 1 except that 25 parts by weight of antimony trioxide and 5 parts by weight of zinc hydroxystannate were used as a flame retardant per 100 parts by weight of the copolymer, and a spun yarn with a metric count of 17 was prepared therefrom.

COMPARATIVE PREPARATION EXAMPLE 5

Preparation of Flame Retardant Halogen-Containing Fiber

A flame retardant halogen-containing fiber was prepared in the same manner as in Preparation Example 1 except that 25 parts by weight of antimony trioxide and 5 parts by weight of zinc hydroxystannate were used as a flame retardant per 100 parts by weight of the copolymer. There were mixed 55% by weight of the flame retardant halogen-containing fiber and 45% by weight of a cotton fiber, and a spun yarn with a metric count of 20 was prepared therefrom.

EXAMPLES 1 AND 2 AND COMPARATIVE EXAMPLES 1 TO 4

Preparation of Union Fabric

A union fabric having a 5-harness satin weave structure was prepared by weaving 135 cotton spun yarns of metric count 51 per 2.54 cm (1 inch) as a warp (content of warp: 46% by weight) and 53 spun yarns of flame retardant halogen-containing fiber prepared in each of Preparation Examples 1 and 2 and Comparative Preparation Examples 1 to 4 per 2.54 cm (1 inch) as a weft (content of weft: 54% by weight). The flame resistance of the obtained union fabrics was evaluated. The results are shown in Table 1.

EXAMPLES 3 TO 5

Preparation of Union Fabric

A union fabric having a 5-harness satin weave structure was prepared by weaving 187 cotton spun yarns of metric count 51 per 2.54 cm (1 inch) as a warp (content of warp: 57% by weight) and 46 spun yarns of flame retardant halogen-containing fiber prepared in each of Preparation Examples 3 to 5 per 2.54 cm (1 inch) as a weft (content of weft: 43% by weight). The flame resistance of the obtained union fabrics was evaluated. The results are shown in Table 1.

COMPARATIVE EXAMPLE 5

Preparation of Blended Yarn Fabric

A blended yarn fabric having a 2/2 twill weave structure was prepared by using the blended yarn prepared in Comparative Example 5 composed of 55% by weight of flame retardant halogen-containing fiber and 45% by weight of cotton fiber as both warp and weft and weaving 80 warps per 2.54 cm (1 inch) and 65 wefts per 2.54 cm (1 inch). The flame resistance of the obtained blended yarn fabric was evaluated. The result is shown in Table 1.

TABLE 1

| | Flame retardant halogen-containing fiber | | | Union fabric (5-harness satin structure) | | Blended yarn fabric (2/2 twill) | | |
|---|---|---|---|---|---|---|---|---|
| | | Amount of flame retardant per 100 parts by weight of copolymer (part by weight) | | Amount of weft of flame retardant halogen- | Amount of warp of | Amount of flame retardant halogen- | Amount of | |
| | Kind | Antimony trioxide | Zinc hydroxy-stannate | containing fiber (wt. %) | cotton fiber (wt. %) | containing fiber (wt. %) | cotton fiber (wt. %) | Flame resistance |
| Ex. 1 | Fiber prepared in Pre. Ex. 1 | 10 | 12 | 54 | 46 | — | — | M1 |
| Ex. 2 | Fiber prepared in Pre. Ex. 2 | 15 | 15 | 54 | 46 | — | — | M1 |
| Ex. 3 | Fiber prepared in Pre. Ex. 3 | 26 | 8 | 43 | 57 | — | — | M1 |
| Ex. 4 | Fiber prepared in Pre. Ex. 4 | 23 | 11 | 43 | 57 | — | — | M1 |
| Ex. 5 | Fiber prepared in Pre. Ex. 5 | 20 | 14 | 43 | 57 | — | — | M1 |
| Com. Ex. 1 | Fiber prepared in Com. Pre. Ex. 1 | 25 | 0 | 54 | 46 | — | — | M2 |
| Com. Ex. 2 | Fiber prepared in Com. Pre. Ex. 2 | 0 | 25 | 54 | 46 | — | — | M2 |
| Com. Ex. 3 | Fiber prepared in Com. Pre. Ex. 3 | 5 | 15 | 54 | 46 | — | — | M2 |
| Com. Ex. 4 | Fiber prepared in Com. Pre. Ex. 4 | 25 | 5 | 54 | 46 | — | — | M2 |
| Com. Ex. 5 | Fiber prepared in Com. Pre. Ex. 5 | 25 | 5 | — | — | 55 | 45 | M1 |

In Table 1, the union fabrics of Examples 1 to 5 prepared using the spun yarns of flame retardant halogen-containing fiber of Preparation Examples 1 to 5, wherein a predetermined amount of antimony trioxide and a predetermined amount of zinc hydroxystannate are used in combination as a flame retardant, and a cotton spun yarn all show a burning test result of M1, and it is found that they have a high flame resistance.

In contrast, the union fabrics of Comparative Examples 1 and 2 prepared using the spun yarns of flame retardant halogen-containing fiber of Comparative Preparation Examples 1 and 2, wherein antimony trioxide or zinc hydroxystannate is used alone as a flame retardant, and a cotton spun yarn show a flame resistance of M2 class, and are inferior in flame resistance to those of Examples 1 to 5. Also, even if antimony trioxide and zinc hydroxystannate are used in combination as a flame retardant, the flame resistance of Comparative Example 3 wherein 5 parts by weight of antimony trioxide and 15 parts by weight of zinc hydroxystannate are used per 100 parts by weight of the acrylic copolymer and Comparative Example 4 wherein 25 parts by weight of antimony trioxide and 5 parts by weight of zinc hydroxystannate are used per 100 parts by weight of the acrylic copolymer, is M2 class and is inferior to that of Examples 1 to 5.

In light of the above, it is understood that union fabrics having a high flame resistance classified into M1 class can be obtained by using predetermined amounts of antimony trioxide and zinc hydroxystannate in combination.

From comparison between Comparative Example 4 and Comparative Example 5, it is found that when the same flame retardant halogen-containing fiber and cotton fiber are used in substantially the same proportion and woven into a fabric (blended yarn fabric) other than union fabric, this fabric shows better flame resistance than the union fabric.

EXAMPLES 6 TO 10

The union fabrics having a 5-harness satin weave structure were subjected to post-treatments: softening treatment (1) wherein the union fabrics were treated with a silicone softening agent (trade mark: High Softer K-10, product of Meisei Kagaku Kabushiki Kaisha, main component: epoxy-modified polysiloxane) which has been popularly used for post-treatment of union fabrics in an amount of 5% omf, and water and oil repellent finish (2) wherein the union fabrics were treated with a water and oil repelling agent (trade mark: Asahi Guard AG-480, product of Asahi Kasei Corporation) in an amount of 5% omf (on the mass of fiber).

The flame resistance of the treated union fabrics was evaluated. The results are shown in Table 2.

TABLE 2

| | Flame retardant halogen-containing fiber | | | Union fabric | | Results of burning test | | |
|---|---|---|---|---|---|---|---|---|
| | | Amount of flame retardant per 100 parts by weight of copolymer (part by weight) | | Amount of weft of flame retardant halogen- | Amount of warp of | | After | After water and oil |
| | Kind | Antimony trioxide | Zinc hydroxy-stannate | containing fiber (wt. %) | cotton fiber (wt. %) | Before treatment | softening finish | repellent finish |
| Ex. 6 | Fiber prepared in Pre. Ex. 1 | 10 | 12 | 54 | 46 | M1 | M1-M2 | M1 |
| Ex. 7 | Fiber prepared in Pre. Ex. 2 | 15 | 15 | 54 | 46 | M1 | M1 | M1 |
| Ex. 8 | Fiber prepared in Pre. Ex. 3 | 26 | 8 | 43 | 57 | M1 | M1 | M1 |
| Ex. 9 | Fiber prepared in Pre. Ex. 4 | 23 | 11 | 43 | 57 | M1 | M1 | M1 |
| Ex. 10 | Fiber prepared in Pre. Ex. 5 | 20 | 14 | 43 | 57 | M1 | M1 | M1 |

From Table 2, it is understood that the union fabrics of Examples 6 to 10 comprising a flame retardant halogen-containing fiber containing a combination of predetermined amounts of antimony trioxide and zinc hydroxystannate pass the M1 class not only before the treatment but also after the water and oil repellent finishing, and pass the M1 class or M1-M2 class also after the softening treatment, thus exhibiting a very high flame resistance.

In light of the above, it is understood that union fabrics having a high flame resistance classified into M1 class can be obtained by using predetermined amounts of antimony trioxide and zinc hydroxystannate in combination, and this high flame resistance is maintained even if they are subjected to a post-treatment.

The results of Examples 1 to 10 and Comparative Examples 1 to 5 are summarized as follows:

A blended yarn fabric wherein a halogen-containing fiber flame retarded by a combination of antimony trioxide and zinc hydroxystannate is uniformly blended with a cotton fiber exhibits a flame resistance of M1 class. However, it has hitherto not been able to obtain a high flame resistance classified into M1 class in the form of a union fabric where unevenly dispersed portions of each of the flame retarded halogen-containing fiber and the cotton fiber are present. Thus, it is understood that, as in the present invention, a combination use of a predetermined amount of antimony trioxide and a predetermined amount of zinc hydroxystannate is essential for obtaining union fabrics having a high flame resistance of M1 class.

INDUSTRIAL APPLICABILITY

The flame retardant union fabric of the present invention has a high flame resistance which passes the M1 class of NF P 92-503 burning test in France.

The invention claimed is:

1. A woven union fabric which is flame retardant said woven fabric being a fabric having a satin structure, comprising:

a) a first yarn including, as a main component, a flame retardant halogen-containing fiber made of a composition which comprises:

i) 100 parts by weight of an acrylic copolymer of 30 to 70% by weight of an acrylonitril, 30 to 70% by weight of a halogen-containing vinyl monomer and 0 to 10% by weight of a vinyl monomer copolymerizable with them, ii) 10 to 30 parts by weight of an antimony compound, and iii) 8 to 30 parts by weight of a zinc stannate compound; and b) a second yarn which comprises a cellulosic fiber;

c) one of said first and second yarns being the warp yarn in said woven fabric and comprising 70% to 30% of said fabric and the other of said first and second yarns being the weft yarn in said woven fabric and comprising 30% to 70% of said fabric, said first and second yarns together comprising 100% of said fabric;

d) said fabric having a satin structure having a weight of at least 227 g/m$^2$ and having flame resistance of M1 class provided in NF P 92-503 burning test wherein the combustion inhibiting effect is provided for both the face on which the second yarn appears to a large extent with relation to the first yarn and the face on which the second yarn appears to only a slight extent, wherein, in the NF P 92-503 burning text, the fabric is tilted at 30° with respect to the horizontal direction, and a 500 W electric heater is brought close to the fabric, and a flame from a burner is applied to the fabric for 5 seconds after 20 seconds, 45 seconds, 75 seconds, 105 seconds, 135 seconds, and 165 seconds from starting the heating with the heater, wherein in the M1 class, the afterflame time is within 5 seconds with respect to all tests of four directions: warp direction of front face, warp direction of back face, weft direction of front face, and weft direction of back face.

2. A woven union fabric which is flame retardant comprising:

a) a first yarn including, as a main component, a flame retardant halogen-containing fiber made of a composition which comprises:

i) 100 parts by weight of an acrylic copolymer of 30 to 70% by weight of an acrylonitril, 30 to 70% by weight of a halogen-containing vinyl monomer and 0 to 10% by weight of a vinyl monomer copolymerizable with them, ii) 10 to 30 parts by weight of an antimony compound, and iii) 10.5 to 30 parts by weight of a zinc stannate compound; and b) a second yarn which comprises a cellulosic fiber;

c) one of said first and second yarns being the warp yarn in said woven fabric and comprising 70% to 30% of said fabric and the other of said first and second yarns being the weft yarn in said woven fabric and comprising 30% to 70% of said fabric; said first and second yarns together comprising 100% of said fabric;

d) said union fabric having flame resistance of M1 class provided in NF P 92-503 burning test wherein the combustion inhibiting effect is provided for both the face on which the second yarn appears to a large extent with relation to the first yarn and the face on which the second yarn appears to only a slight extent, wherein, in the NF P 92-503 burning test, the fabric is tilted at 30° with respect to the horizontal direction, and a 500 W electric heater is brought close to the fabric, and a flame from a burner is applied to the fabric for 5 seconds after 20 seconds, 45 seconds, 75 seconds, 105 seconds, 135 seconds, and 165 seconds from starting the heating with the heater, wherein in the M1 class, the afterflame time is within 5 seconds with respect to all tests of four directions: warp direction of front face, warp direction of back face, weft direction of front face, and weft direction of back face.

3. The flame retardant union fabric of claim 1, wherein said yarn comprising a flame retardant halogen-containing fiber as a main component is a composite yarn of 80 to 100% by weight of said flame retardant halogen-containing fiber and 0 to 20% by weight of a cellulosic fiber.

4. The flame retardant union fabric of claim 1, wherein said yarn comprising a cellulosic fiber includes at least one fiber selected from the group consisting of cotton, hemp, rayon, polynosic, cuprammonium rayon, acetate and triacetate.

5. The flame retardant union fabric of claim 2, wherein said yarn comprising a flame retardant halogen-containing fiber as a main component is a composite yarn of 80 to 100% by weight of said flame retardant halogen-containing fiber and 0 to 20% by weight of a cellulosic fiber.

6. The flame retardant union fabric of claim 2, wherein said cellulosic fiber yarn is at least one fiber selected from the group consisting of cotton, hemp, rayon, polynosic, cuprammonium rayon, acetate and triacetate.

7. The flame retardant union fabric of claim 1, which has a weight of 227 to 251 g/m$^2$.

8. The flame retardant union fabric of claim 2, which has a satin structure.

9. The flame retardant union fabric of claim 2, wherein the amount of said zinc stannate compound is from 12 to 30 parts by weight per 100 parts by weight of said acrylic copolymer.

10. The flame retardant union fabric of claim 9, which has a satin structure.

* * * * *

UNITED STATES PATENT AND TRADEMARK OFFICE

CERTIFICATE OF CORRECTION

PATENT NO. : 7,365,032 B1
APPLICATION NO. : 10/129407
DATED : April 29, 2008
INVENTOR(S) : Masayuki Adachi et al.

It is certified that error appears in the above-identified patent and that said Letters Patent is hereby corrected as shown below:

On the Title Page

Item (87), delete "Oct. 5, 2001" and substitute --May 10, 2001-- in its place.

Signed and Sealed this

Sixteenth Day of September, 2008

JON W. DUDAS
*Director of the United States Patent and Trademark Office*